US010697156B2

(12) United States Patent
Paul et al.

(10) Patent No.: US 10,697,156 B2
(45) Date of Patent: Jun. 30, 2020

(54) APPARATUS FOR PURGING WATER FROM A PLUMBING INSTALLATION

(75) Inventors: Jason Paul, Belfast (GB); Brian Colligan, Lisburn (GB)

(73) Assignee: Apt Innovations Limited, Belfast (IE)

( * ) Notice: Subject to any disclaimer, the term of this patent is extended or adjusted under 35 U.S.C. 154(b) by 225 days.

(21) Appl. No.: 13/824,682

(22) PCT Filed: Sep. 16, 2011

(86) PCT No.: PCT/GB2011/051750
§ 371 (c)(1),
(2), (4) Date: Oct. 1, 2013

(87) PCT Pub. No.: WO2012/035359
PCT Pub. Date: Mar. 22, 2012

(65) Prior Publication Data

US 2014/0026928 A1 Jan. 30, 2014

Related U.S. Application Data

(60) Provisional application No. 61/394,905, filed on Oct. 20, 2010.

(30) Foreign Application Priority Data

Sep. 16, 2010 (GB) ..... 1015472.2
Mar. 9, 2011 (GB) ..... 1104002.9

(51) Int. Cl.
*E03B 7/12* (2006.01)

(52) U.S. Cl.
CPC ..... *E03B 7/12* (2013.01)

(58) Field of Classification Search
USPC ..... 134/166 C, 166 R, 169 R; 3/166 C, 3/166 R, 169 R
See application file for complete search history.

(56) References Cited

U.S. PATENT DOCUMENTS

| | | | | |
|---|---|---|---|---|
| 3,845,779 | A | 11/1974 | Greene | |
| 4,848,389 | A | 7/1989 | Pirkle | |
| 5,220,937 | A * | 6/1993 | Roberts | E03B 7/12 122/504 |

(Continued)

FOREIGN PATENT DOCUMENTS

| | | |
|---|---|---|
| DE | 829098 | 1/1952 |
| DE | 4025196 | 3/1991 |
| FR | 2876632 | 4/2006 |

OTHER PUBLICATIONS

Definition of in-line by Merriam-Webster (ww.merriam-webster.com, cited Sep. 3, 2015).*

(Continued)

*Primary Examiner* — Rita P Adhlakha
(74) *Attorney, Agent, or Firm* — Preston Smirman; Smirman IP Law, PLLC

(57) ABSTRACT

An apparatus (100) for purging water from a plumbing installation (120) having a length of conduit (110) with a first connector (151) fixed at a first end (111) thereof and a second connector (161) fixed at a second end (112) thereof. The first connector (151) is mated with an outlet of a pump (130), the second connector (161) is mated with a fitting of the plumbing installation (120) and at least one connector having a valve (155, 165).

18 Claims, 6 Drawing Sheets

(56) References Cited

U.S. PATENT DOCUMENTS

| | | | | |
|---|---|---|---|---|
| 5,433,246 | A * | 7/1995 | Horton | 137/565.12 |
| 5,676,182 | A * | 10/1997 | McMullen, Jr. | E03B 7/12 137/240 |
| 5,734,109 | A * | 3/1998 | Thanscheidt | 73/744 |
| 5,803,111 | A | 9/1998 | Soszka | |
| 2005/0236043 | A1 | 10/2005 | Zhurin et al. | |
| 2007/0204884 | A1 * | 9/2007 | Moore | B08B 9/0321 134/22.1 |
| 2014/0026928 | A1 * | 1/2014 | Paul | E03B 7/12 134/166 C |

OTHER PUBLICATIONS

English Abstract of FR2876632.
English Abstract of DE4025196.
English Abstract of DE829098.
International Search Report for PCT/GB2011/051750.

* cited by examiner

APPARATUS FOR PURGING WATER FROM A PLUMBING INSTALLATION

CROSS-REFERENCE TO RELATED APPLICATION

The instant application is a national phase of, and claims priority to, PCT International Application No. PCT/GB2011/051750, filed on Sep. 16, 2011, pending, GB Patent Application Serial No. 1104002.9, filed on Mar. 9, 2011, pending, U.S. Provisional Patent Application Ser. No. 61/394,905, filed on Oct. 20, 2010, and GB Patent Application Serial No. 1015472.2, filed on Sep. 16, 2010, pending, the entire specifications of all of which are expressly incorporated herein by reference.

FIELD OF USE

The present invention relates to the field of apparatus for purging water from plumbing installations also known as winterizing apparatus.

DESCRIPTION OF THE RELATED ART

The freezing of plumbing installations containing water which often occurs during extended cold periods can give rise to substantial and costly problems. Water trapped inside pipes expands when it freezes; the expansion of the water as it turns to ice can cause mechanical failure of the pipe, or can damage a fitting in the plumbing installation; as the ice thaws, the damaged pipes and fittings leak causing flooding. The cost arising from settling claims for damage resulting from the bursting of pipes and from the subsequent flood damage during the early part of 2010 was estimated by the Irish insurance industry at approximately 300 million Euro. Proportionately similar costs were estimated by the insurance industries in the UK, parts of North America and Canada.

The types of dwellings which are most likely to suffer from damage caused by freezing of pipes are seasonal dwellings, which may be vacant for a substantial part of the cold season and which are left unheated. Such dwellings include summer houses. However, any property is subject to damage. Mobile dwellings such as caravans, motor homes, recreational vehicles, boats such as cruisers and barges and the like are also prone to damage arising from freezing and burst pipes. The damage to seasonal dwellings and mobile vehicles from freezing pipes is often exasperated by the fact that discovery of a leak or flood may only be made a long time after the damage has occurred.

Another category of plumbing installation which is at risk from the effects of freezing during winter periods is any external system, such as those used for irrigation, and sprinkling of garden areas.

One solution to the potential problem of water damage from burst pipes is to install a plumbing system having a shut-off valve and a containment tank. In such systems, after the water is shut-off any remaining water in the plumbing is drained into the containment tank. This process is carried out before an occupier of the dwelling departs or closes down the dwelling for an extended period. While such systems are effective, they are costly to install. Moreover, such complex systems would be excessive for small dwellings or mobile homes which typically only comprise one or two branches of piping to be drained.

Clearly, a compact and portable apparatus capable of purging water from a wide range of plumbing installations would be highly beneficial. Ideally, such an apparatus could be deployed on an existing plumbing installation without the need for any modification to the installation.

STATEMENT OF THE INVENTION

Accordingly, the present invention provides an apparatus for purging water from a plumbing installation comprising:
a length of conduit comprising a first connector fixed at a first end thereof and a second connector fixed at a second end thereof;
the first connector being mateable with an outlet of a pump;
the second connector being mateable with a fitting of the plumbing installation;
at least one connector having valve means.

Ideally, the second connector comprising a valve.

Preferably, the valve of the second connector is openable when the second connector is connected to the fitting of the plumbing installation, and is closable when the connector is disconnected from the fitting of the plumbing installation.

Ideally, the first connector comprising a first valve which allows air or gas to flow in a direction from the first end of the conduit to the second end of the conduit.

Preferably, the first connector is an automobile tyre connector mateable with an outlet connector of an automobile tyre pump.

Preferably, the second valve stops the flow of air or gas from the second connector when closed.

Preferably, the second connector is mateable with a corresponding connector of the plumbing installation.

Preferably, the second connector is a female connector, mateable with a male connector of the plumbing installation.

Preferably, the second connector is mateable with a threaded plumbing fitting having a diameter equal to one of: ½ inch, ¾ inch, 1 inch or any fitting up to 12 inches and beyond.

In one embodiment, the second connector is mateable with a fitting of the plumbing installation via an adapter. Preferably, the adapter is mateable with a threaded plumbing fitting having a diameter equal to one of: ½ inch, ¾ inch, 1 inch or any fitting up to 12 inches and beyond. Alternatively, the adapter is mateable with a faucet/tap of the plumbing fitting. The adapter may further comprise a valve which permits the flow of air or gas from the conduit to the plumbing installation but which blocks the flow of fluid or gas from the plumbing installation to the conduit.

Preferably, the conduit is a tube; advantageously the tube is formed of a flexible or rigid material.

In some embodiments, the plumbing installation is installed in one of: a mobile home, an occasional or full time residence, a motorized home, a recreational vehicle (RV), a boat or sprinkler system.

In one embodiment, the length of conduit further comprises a reservoir, between its first and second ends, the reservoir being capable of storing a quantity of pressurised gas. Advantageously, the reservoir can store a quantity of air or gas sufficient to expel water from at least one section of the plumbing installation.

In one embodiment, the conduit further comprises a pressure sensor. Preferably, the pressure sensor is a mechanical sensor, such as a manometer. Alternatively, the pressure sensor may be an electronic sensor.

Accordingly, the present invention also provides an apparatus for removing fluid from a plumbing installation comprising a plumbing installation and a fitting, fixably attached in-line with the plumbing installation so that fluid flowing through the plumbing installation passes through the fitting, the fitting being mateable to a connector of a pump for pumping residual fluid out of the plumbing installation, the fitting having a valve for preventing passage of fluid from the plumbing installation into the connector and on to the pump.

Advantageously, an operator can simply connect a pump to the in-built fitting to clear the left over water for example from the plumbing installation.

Ideally, the fluid is water.

Preferably, the apparatus further comprises a pump having a connector mateable with a portion of the fitting.

Ideally, the pump is locatable within a dwelling or structure served by the plumbing installation.

Ideally, the pump is operable by a switch or other means of activation located within the dwelling or structure served by the plumbing installation.

Preferably, the switch or other means of activation couples the pump to a power supply.

Ideally, the power supply is a 12V DC or a 240 V AC power supply.

Alternatively, the pump comprises a charged canister containing pressurised gas, which can be discharged selectively by the operator.

Ideally, the charged canister is chargeable/re-chargeable electronically by compressor.

Alternatively, the charged canister can be chargeable/re-chargeable using a self inflating bladder contained within the charged canister.

Preferably, the pump is fitted with a pressure sensor to measure the generated pressure of the fluid the pump is transferring.

Ideally, the pump has limiter switch means to switch the pump off or on at a predetermined pressure level.

Preferably, the limiter switch has an upper limit of approximately 30 psi. Advantageously, this pressure suits fixed homes and caravans.

Alternatively, the limiter switch has an upper pressure limit of approximately 15 psi. Advantageously, this pressure suits towing caravans, motor homes, and boats.

Preferably, the pressure sensor is a mechanical sensor, such as a manometer. Alternatively, the pressure sensor may be an electronic sensor.

Ideally, the fitting has a connector protruding from the plumbing installation.

Preferably, the connector is a threaded plumbing fitting having a diameter equal to one of: ½ inch, ¾ inch, 1 inch or any fitting up to 12 inches and beyond.

Preferably, the valve in the fitting permits the flow of fluid from the pump to the plumbing installation but blocks the flow of fluid from the plumbing installation to the pump.

Ideally, the valve is a Schrader type valve. Alternatively, the valve is a motorized valve.

In some embodiments, the plumbing installation is installed in one of: a mobile home, an occasional or full time residence, a motor home, a recreational vehicle (RV), a boat/barge or sprinkler system.

Preferably, a length of tubing connects the pump to the connector.

Preferably, the pump is permanently connected to the plumbing installation.

Ideally, the connector is permanently connected to the fitting. Advantageously, the fluid removing apparatus is built into the plumbing installation as an integrated component.

Preferably, in the integrated embodiment, a wiring loom is used to couple switch means to the pump. In this embodiment, the pump switch means can be located with various other switches on a centrally located electrical control panel.

Embodiments of the present invention will now be described in detail with reference to the accompanying figures in which:

DETAILED DESCRIPTION

Figure 1:
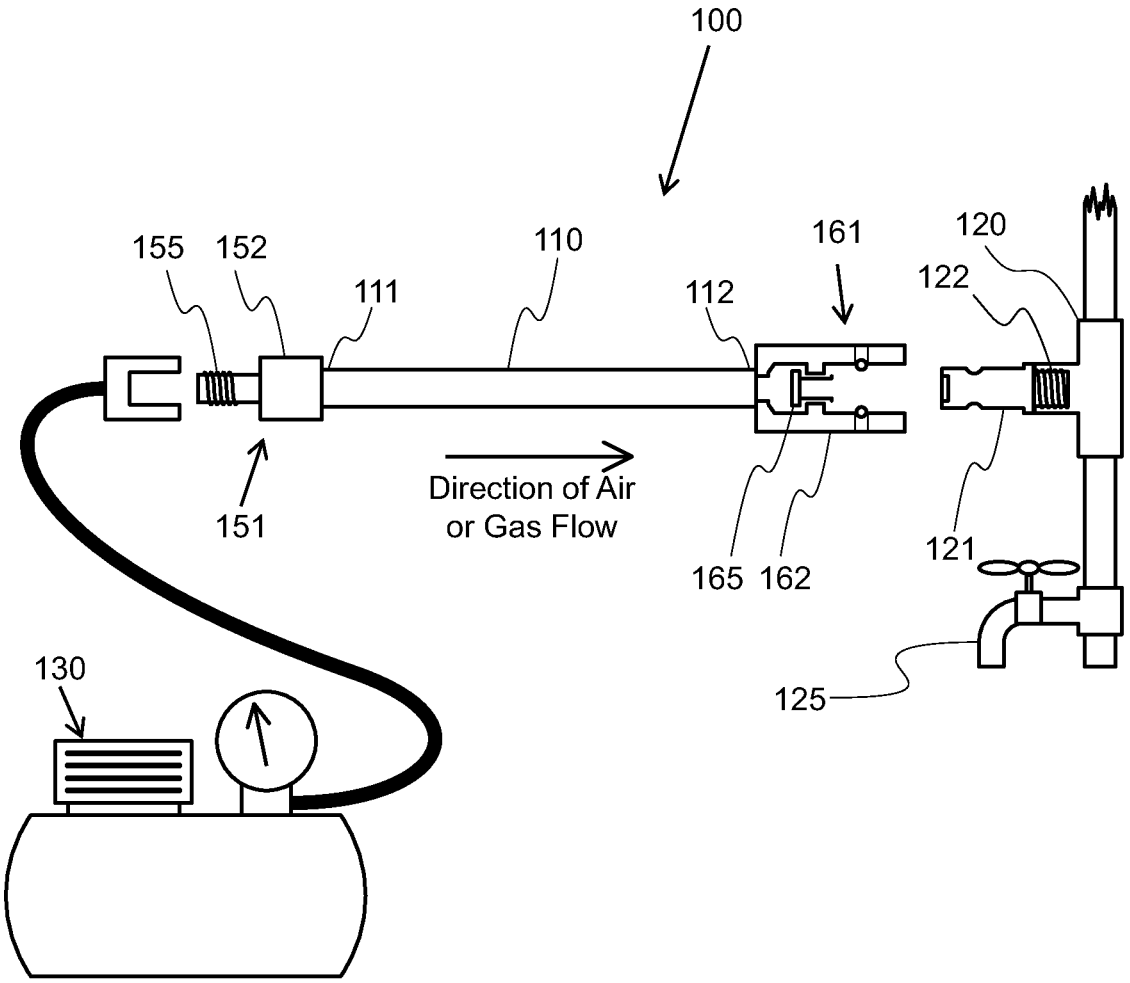
FIG. 1 shows a diagram of an apparatus for purging water from a plumbing installation according to a first embodiment of the present invention.
Figure 2A:
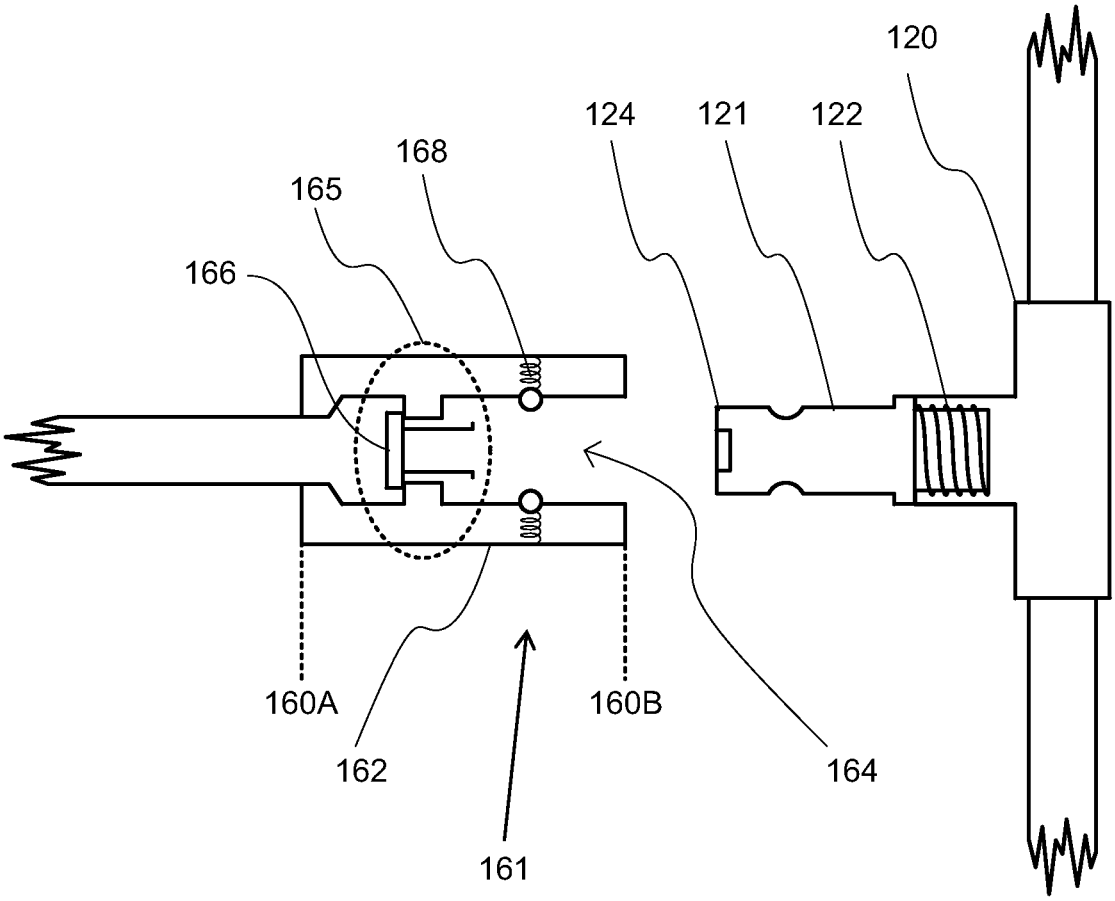
FIG. 2A shows a diagram of a second connector of an apparatus for purging water from a plumbing installation according to an embodiment of the present invention and an adapter of the plumbing installation.
Figure 2B:
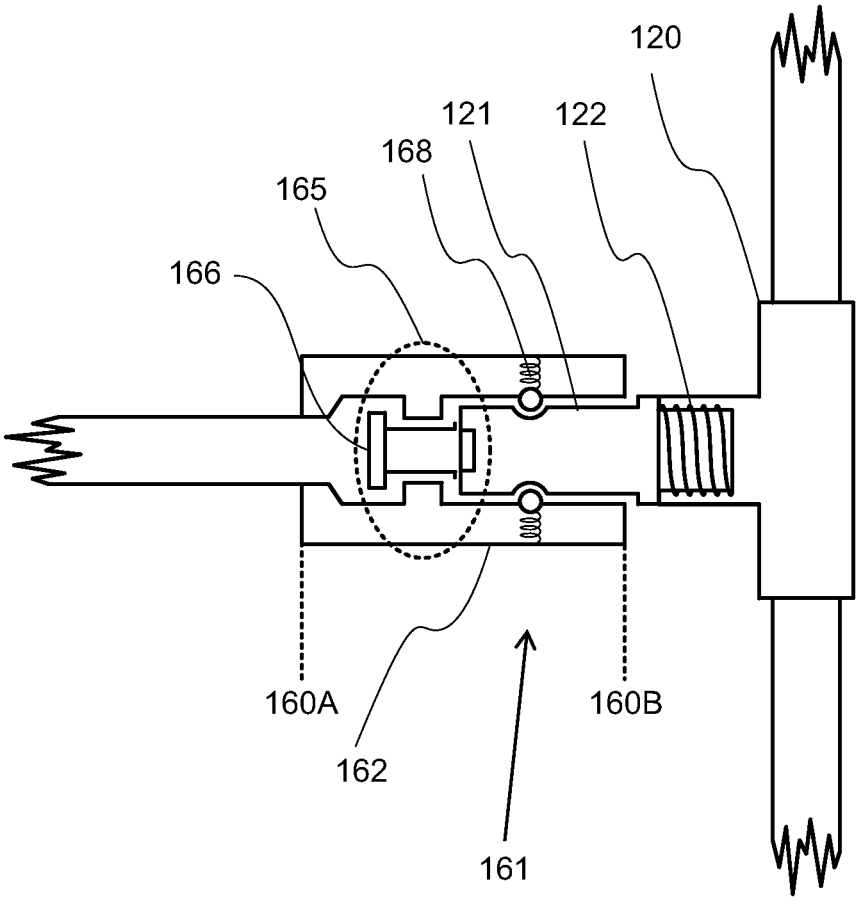
FIG. 2B shows a diagram of a second connector of an apparatus for purging water from a plumbing installation according to an embodiment of the present invention mated with an adapter of the plumbing installation.

FIG. 1 shows a diagram of an apparatus 100 for purging water from a plumbing installation 120 according to an embodiment of the present invention. FIG. 2A and FIG. 2B show a detailed views of a second connector 161 of the apparatus of FIG. 1 for purging water from a plumbing installation 120 and of an adapter 121 which connects to the plumbing installation.

For clarity, the same reference numerals are used to describe identical features of FIG. 1, FIG. 2A and FIG. 2B.

The apparatus of FIG. 1 comprises a length of conduit 110 comprising a first connector 151 fixed at a first end 111 of the conduit and a second connector 161 fixed at a second end 112 of the conduit.

The first connector 151 comprises a flange 152 or gripping area such as ribs (not shown) accommodating a valve 155 of the type typically used on automobile tyres and commonly referred to as a Schrader valve, after August Schrader who is credited with its invention in 1891. Valve 155 has a threaded outer diameter, for connection with an outlet of tyre pump 130, and allows air or gas to flow in a direction from the first end 111 of the conduit to the second end 112 of the conduit.

The second connector 161 is mateable with an adapter 121 which is attached to a fitting of the plumbing installation 120.

The second connector 161 comprises an outer body 162 providing mechanical support for a second connector valve 165. Second connector valve 165 opens when the second connector 161 is connected to the plumbing installation adapter 121; similarly, second connector valve 165 closes when the second connector 161 is disconnected from the plumbing installation adapter 121.

In use, a water supply shut-off valve (not shown) for plumbing installation 120 is closed, so that water can no longer enter the system from the external supply or well. Residual water is then drained from the tap which should be open. An automobile tyre pump 130 is connected to first connector 151 so that air or gas can be pumped into the conduit 110 at its first end 111. The first connector valve 155 prevents the air or gas from escaping back through connector 151 if the pump 130 is disconnected.

When second connector 161 is connected to plumbing installation adapter 121, second connector valve 165 opens, so that air or gas which is pumped into first connector 151 via tyre pump 130 passes through conduit 110 and on to plumbing installation 120. In this way, a pressure of air or gas builds up inside plumbing installation 120, which may be released by opening a faucet/tap 125 or toher suitable plumbing fitting to gain entry to the water system downstream of the apparatus of the present invention 100. The sudden expulsion of the air or gas which has been pumped into the installation 120 by opening faucet/tap or other fitting 125 causes any water which is trapped inside the plumbing installation to exit from the open faucet/tap or other fitting 125.

If the plumbing installation 120 comprises several branches (not shown) each having a corresponding faucet or tap, the trapped water can be purged from all of the branches by a sequential process as follows: pumping air or gas into the plumbing installation; opening a faucet/tap or other fitting attached to one particular branch and allowing the water to be purged from the corresponding branch; closing off that tap; repeating the process of building air pressure for a different branch of the installation having a different faucet/tap or other fitting until all of the branches have been purged. A particular sequence of purging the respective branches of the plumbing installation may provide the most expeditious route to removing all of the water from the system. For example, it may be appropriate to begin with branches of the plumbing installation which are located higher up, and to finish with branches of the plumbing installation which are lower down, so that any movement of the water due to gravity does not cause a purged branch of the plumbing installation to fill up once again.

The plumbing installation adapter 121 is chosen for quick attachment of the apparatus 100 of the present invention so that water can be purged from the plumbing installation 120 rapidly. Adapter 121 comprises a threaded portion 122 for attachment to a threaded fitting of the plumbing installation. Such fittings may include (but are not limited to) threaded plumbing fittings having a diameter equal to one of: ½ inch, % inch, 1 inch or any fitting up to 12 inches and beyond. Alternatively, adapter 121 may comprise a flange having a push fit for connection to plumbing installation 120 or may comprise a portion facilitating twist lock connection with plumbing installation 120. Further alternatively, the adapter is mateable with a faucet or tap of the plumbing fitting.

FIG. 2A shows a diagram of the second connector 161 of the apparatus 110 for purging water from a plumbing installation according to the embodiment of the present invention depicted in FIG. 1, where the second connector is aligned to be mated with an adapter 121 of the plumbing installation.

FIG. 2B shows a diagram of the second connector 161 of an apparatus 110 for purging water from a plumbing installation according to the embodiment of the present invention depicted in FIG. 1, where the second connector is mated with an adapter 121 of the plumbing installation.

Second connector 161 comprises a stop valve 165 and has an outer body 162, which provides mechanical support for valve 165 and other parts of the inner mechanism of second connector 161. Second connector 161 is formed to have a substantially cylindrical or concave inner orifice 164 to accommodate a protruding portion 124 of the adapter 121 of plumbing installation 120. Second connector 161 further comprises releasable lugs 168 for engaging with one or more indentations around the circumference of adapter 121 of the plumbing installation 120. Second connector 161 may optionally further comprise a washer formed of a flexible material such as rubber or soft plastic to provide an air tight and water tight fit between the second connector 161 of the apparatus of the present invention and plumbing installation adapter 121.

Second connector 161 is directional, and has an input side 160A and an output side 160B. Stop valve 165 has a cover 166 which closes against a build up of pressure on its input side 160A. In this state, second connector 161 is closed against a flow of fluid or gas from its input side 160A to its output side 160B—see FIG. 2A.

Plumbing installation adapter 121 comprises a threaded portion 122 for mating with a fitting of plumbing installation 120 and further comprises a protruding portion 124 for mating with second connector 161 of the apparatus of the present invention. When mated together, the protruding portion 124 of plumbing installation adapter 121 engages a portion of cover 166 of second connector 161 thereby causing second connector to switch to its open state—as shown in FIG. 2B.

In the embodiments of the present invention shown in FIG. 1, FIG. 2A, FIG. 2B and FIG. 3, plumbing installation adapter 121 comprises a threaded portion 122 for directly engaging with a threaded fitting of plumbing installation 120. The threaded portion of plumbing may provide an inverse fit for a female plumbing fitting having a diameter equal to one of: ½ inch, ¾ inch, 1 inch or any fitting up to 12 inches and beyond. Nonetheless, the present invention is not limited to any specific adapter and may include variants to connect the apparatus 110 to a wide range of plumbing fittings.

Figure 3:
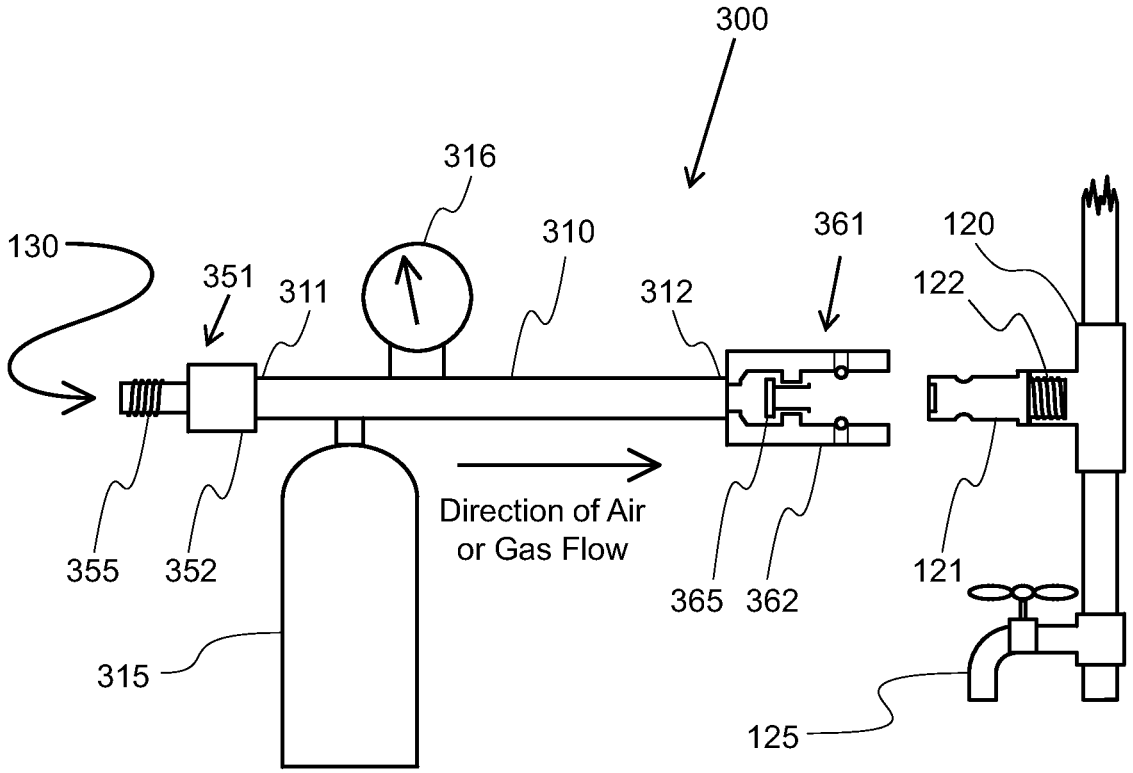
FIG. 3 shows a diagram of an apparatus for purging water from a plumbing installation according to a second embodiment of the present invention.

FIG. 3 shows a diagram of an apparatus for purging water from a plumbing installation according to a second embodiment of the present invention.

The apparatus of FIG. 3 comprises a length of conduit 310 comprising a first connector 351 fixed at a first end 311 of the conduit and a second connector 361 fixed at a second end 312 of the conduit. Conduit 310 further comprises a reservoir tank 315 located between its first end 311 and its second end 312. A manometer 316 is also connected to conduit 310, for measuring the pressure of the air or gas inside conduit 310 and reservoir tank 315.

The first connector 351 comprises a flange 352 or domed end (not shown) having an automobile tyre valve 355 fitted. Valve 355 allows air or gas to flow in a direction from the first end 311 of the conduit to the second end 312 of the conduit.

In use, an outlet of automobile tyre pump 130 or any compressor, most preferably a digital compressor with an auto shut off function, is connected to first connector 351 so that air or gas can be pumped into the conduit 310 at its first end 311. Air or gas pressure builds up inside conduit 310 and reservoir tank 315 over a period of time so that the trapped air or gas has a corresponding unpressurised volume which is greater than that of the combined inner volume of conduit 310 and reservoir tank 315. Ideally, the corresponding unpressurised volume of gas is several times that of the combined inner volume of conduit 310 and reservoir tank 315. Specifically, after pressurization, the corresponding unpressurised volume of gas may be up to twenty times that of the combined inner volume of conduit 310 and reservoir tank 315, corresponding to pressure of approximately twenty atmospheres. Manometer 316 provides a measure of the pressure of the air or gas inside reservoir tank 315 and conduit 310. Manometer 316 provides a safety means against the over inflation of reservoir tank 315.

Conduit 310 may further comprise a pressure release valve (not shown). For example, a pressure release valve may be included so that the pressure inside the reservoir tank 315 cannot exceed a particular level.

Second connector 361 is mateable with an adapter 121 of the plumbing installation 120. Adapter 121 is connected to plumbing installation via a threaded portion 122. The second connector 361 comprises a second connector valve 365 which has a closed state and an open state. Second connector valve 365 is initially closed allowing the air or gas pressure to build up inside conduit 310 and reservoir tank 315. Second connector valve 365 opens when the second connector is connected to the plumbing installation adapter 121. Connection of second connector valve to plumbing installation adapter 121 in this way, causes the trapped air or gas which is inside conduit 310 and reservoir tank 315 to be transferred to the plumbing installation. The build up of air or gas inside the plumbing installation enables any trapped water therein to be purged by opening one or more faucets or taps 122 which are fitted to the plumbing installation.

To fully purge the trapped water from the plumbing installation, this procedure may be repeated several times, each time opening a different faucet or tap of the plumbing installation to flush water from different sections or branches of the plumbing installation sequentially.

In use, the pump 130 of the embodiment of the present invention depicted in FIG. 3 may be remote from the plumbing installation 120. In this case, conduit 310 and reservoir tank 315 are pressurised remotely, and are then brought to the plumbing installation so that water trapped therein may be purged.

Figure 4:
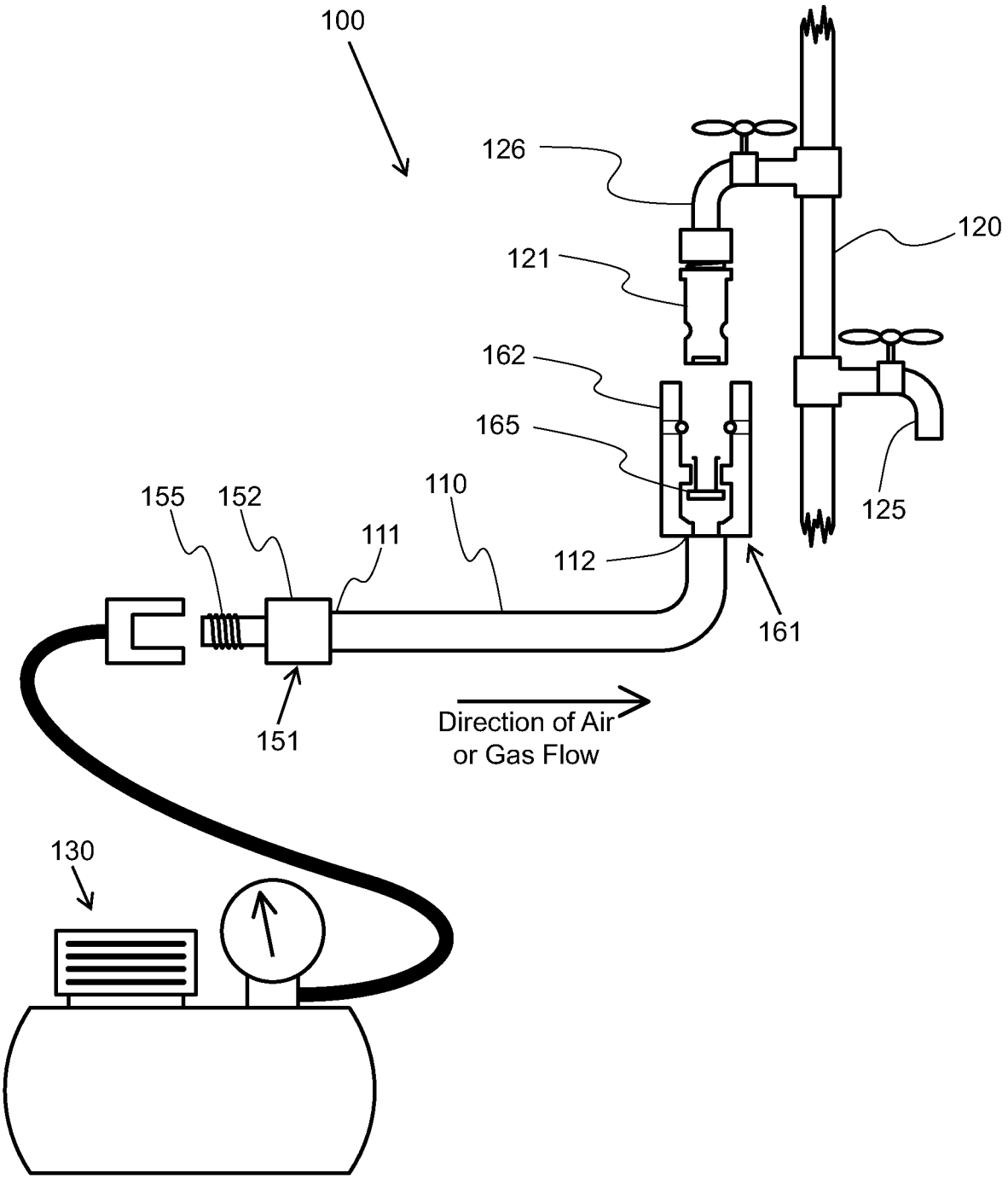
FIG. 4 shows a diagram of an apparatus for purging water from a plumbing installation according to an embodiment of the present invention wherein the apparatus is connected to a tap/faucet of the plumbing installation.

FIG. 4 shows a diagram of an apparatus for purging water from a plumbing installation according to an embodiment of the present invention wherein the apparatus is connected to a tap or faucet 125 of the plumbing installation 120.

The apparatus of FIG. 4 comprises a length of conduit 110 comprising a first connector 151 fixed at a first end 111 of the conduit and a second connector 161 fixed at a second end 112 of the conduit.

The first connector 151 comprises a flange 152 accommodating a valve 155 of the type typically used on automobile tyres and commonly referred to as a Schrader valve. Valve 155 has a threaded outer diameter, for connection with an outlet of a tyre pump 130, and allows air or gas to flow in a direction from the first end 111 of the conduit to the second end 112 of the conduit.

The second connector 161 is mateable with an adapter 121 which is attached to a faucet or tap 125 of the plumbing installation 120. Ideally faucet or tap 125 is located on the plumbing installation 120 at some point near or adjacent to the main shut-off valve.

The second connector 161 comprises an outer body 162 providing mechanical support for a second connector valve 165. Second connector valve 165 opens when the second connector 161 is connected to the plumbing faucet or tap 125 via adapter 121; similarly, second connector valve 165 closes when the second connector 161 is disconnected from the faucet or tap 125.

In use, a water supply shut-off valve (not shown) for plumbing installation 120 is closed, so that water can no longer enter the system from the external supply or well. Faucet or tap 125 is then opened. An automobile tyre pump 130 is connected to first connector 151 so that air or gas can be pumped into the conduit 110 at its first end 111. The first connector valve 155 prevents the air or gas from escaping back through connector 151 if the pump 130 is disconnected.

When second connector 161 is connected to faucet or tap 125 via adapter 121, second connector valve 165 opens, so that air or gas which is pumped into first connector 151 via tyre pump 130 passes through conduit 110 and on to plumbing installation 120. In this way, a pressure of air or gas builds up inside plumbing installation 120, which may be released by opening a faucet or tap 125 downstream of the apparatus of the present invention. The sudden expulsion of the air or gas which has been pumped into the installation 120 by opening a downstream faucet or tap 125 causes any water which is trapped inside the plumbing installation to exit from the open faucet or tap 125.

Thus, the apparatus present invention as described herein provides a compact and portable apparatus capable of purging water from a wide range of plumbing installations. The apparatus of the present invention can be deployed on a range of existing plumbing installation without there being a need for modification to the installation. The apparatus of the present invention can be rapidly deployed and provides a means to purge water from a plumbing installation quickly.

The apparatus of the present invention 100 as depicted in the first embodiment of FIG. 1 and the embodiments of FIG. 3 and FIG. 4 may alternatively be connected directly to a connector or a faucet or tap of a plumbing installation 120. In this case, adapter 121 is superfluous.

Figure 5:
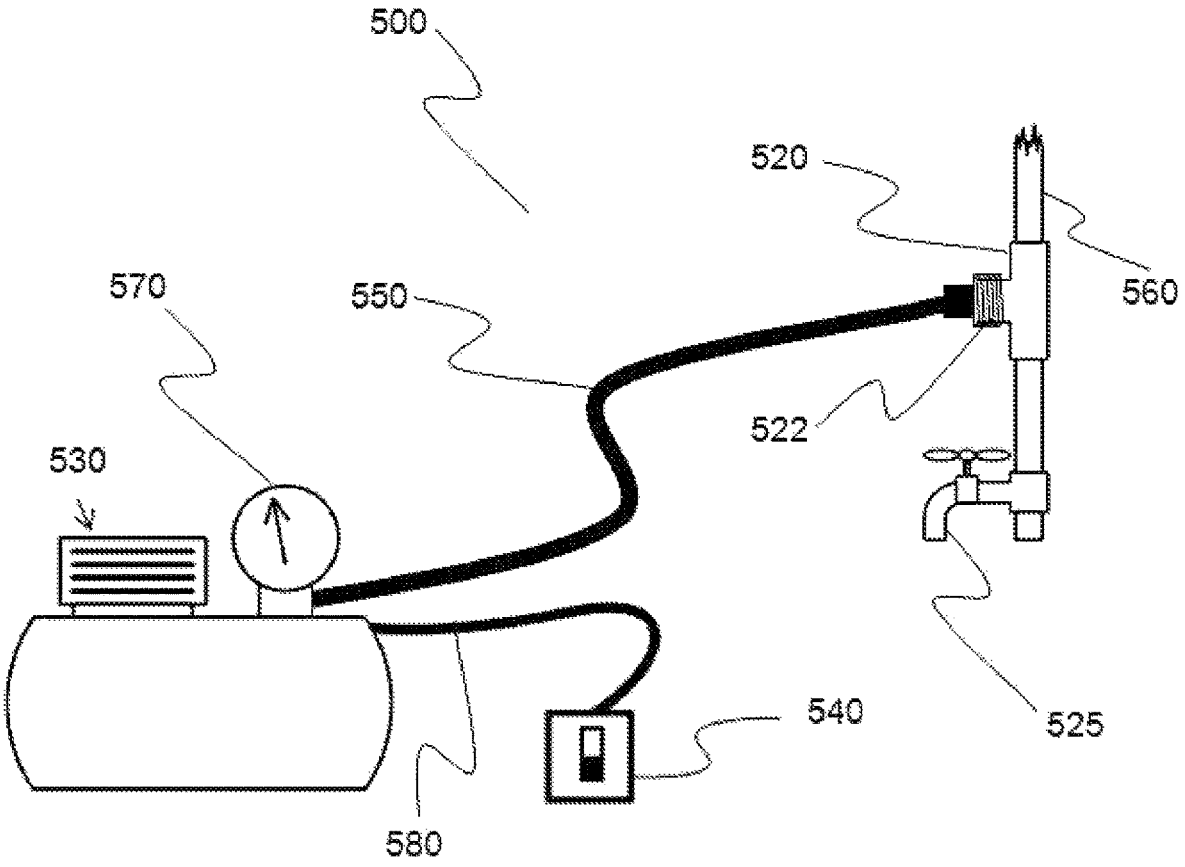
FIG. 5 shows a diagram of an apparatus for removing water from a plumbing installation according to the present invention.

FIG. 5 shows a diagram of an apparatus 500 for removing water from a plumbing installation 560 according to the present invention. The apparatus 500 has a plumbing installation 560 and a fitting 520, fixably attached in-line with the plumbing installation 560 so that fluid flowing through the plumbing installation 560 passes through the fitting 520. The fitting 520 is mated to a connector 522 of a pump 530 for pumping residual fluid out of the plumbing installation 560. The fitting 520 has a valve similar to the valve 155, 165 of FIGS. 1 to 4 for preventing passage of fluid from the plumbing installation 560 into the connector 522 and on to the pump 530. Advantageously, an operator can simply connect a pump 530 to the in-built fitting 520 to clear the left over water for example from the plumbing installation 560.

The apparatus 500 has a pump 530 having a connector 522 mated with a portion of the fitting 520. The pump 530 is located within a dwelling or structure served by the plumbing installation 560. The pump 530 is operable by a switch 540 or other member of activation located within the dwelling or structure served by the plumbing installation 560. The switch 540 or other member of activation couples the pump to a power supply. The power supply is a 12V DC or a 240 V AC power supply. The pump 530 is fitted with a pressure sensor 570 to measure the generated pressure of the fluid the pump 530 is pumping. The pump 530 has a limiter switch to switch the pump 530 off or on at a predetermined pressure level.

The limiter switch has an upper limit of approximately 30 psi. Advantageously, this pressure suits fixed homes and caravans. Alternatively, the limiter switch has an upper pressure limit of approximately 15 psi. Advantageously, this pressure suits towing caravans, motor homes, and boats. The pressure sensor 570 is a mechanical sensor, such as a manometer. Alternatively, the pressure sensor 570 is an electronic sensor.

The fitting 520 has a connector 522 protruding from the plumbing installation 560. The connector 522 is a threaded plumbing fitting and has a diameter equal to one of: ½ inch, ¾ inch, 1 inch or any fitting up to 12 inches and beyond. The valve in the fitting 520 permits the flow of fluid from the pump 530 to the plumbing installation 560 but blocks the flow of fluid from the plumbing installation 560 to the pump 530. The valve is a Schrader type valve. Alternatively, the valve is a motorized valve. In some embodiments, the plumbing installation 560 is installed in one of: a mobile home, an occasional or full time residence, a motor home, a recreational vehicle (RV), a boat/barge or sprinkler system.

A length of tubing 550 connects the pump 530 to the connector 522. The pump 530 is permanently connected to the plumbing installation 560. The connector 522 is permanently connected to the fitting 520. Advantageously, the fluid removing apparatus 500 is built into the plumbing installation 560 as an integrated component.

A wiring loom 580 is used to couple switch member 540 to the pump 530. In this embodiment, the pump switch member 540 is located with various other switches on a centrally located electrical control panel.

In use, a water supply shut-off valve (not shown) for plumbing installation 560 is closed, so that water can no longer enter the system from the external supply or well. Residual water is then drained from the tap 525 which should be open and which is closed again once the water has drained. Pump 530 is connected to the fitting 520 through connector 522, if the pump is not permanently coupled thereto, so that air or gas can be pumped into plumbing installation 560. The valve in fitting 520 prevents the air, gas, or residual water from escaping back through connector 522 when the pump 530 is deactivated.

On activation of the pump 530, a pressure of air or gas builds up inside plumbing installation 560, which may be released by opening a faucet/tap 525 or other suitable plumbing fitting downstream of the apparatus of the present invention 500. The sudden expulsion of the air or gas which has been pumped into the installation 560 by opening faucet/tap or other fitting 525 causes any water which is trapped inside the plumbing installation 560 to exit from the open faucet/tap or other fitting 525.

If the plumbing installation 560 comprises several branches (not shown) each having a corresponding faucet or tap 525, the trapped water can be purged from all of the branches by a sequential process as follows: pumping air or gas into the plumbing installation 560; opening a faucet/tap 525 or other fitting attached to one particular branch and allowing the water to be pressurised from the corresponding branch; closing off that tap 525; repeating the process of building air pressure for a different branch of the installation having a different faucet/tap 525 or other fitting until all of the branches have been cleared. A particular sequence of clearing the respective branches of the plumbing installation 560 may provide the most expeditious route to removing all of the water from the system. For example, it may be appropriate to begin with branches of the plumbing installation 560 which are located higher up, and to finish with branches of the plumbing installation 560 which are lower down, so that any movement of the water due to gravity does not cause a cleared branch of the plumbing installation 560 to fill up once again. During each pressurization cycle, the Pump 530 will utilise a pressure sensing member combined with limiting member to automatically cut-off the pumping action at a pre-determined pressure level. This Pre-determined pressure level may vary depending on the type of plumbing installation 560, for example, the limiter switch has an upper limit of approximately 30 psi when utilized in fixed homes and caravans. Alternatively, the limiter switch has an upper pressure limit of approximately 15 psi when utilized in towing caravans, motor homes, and boats. When the pressure falls to a value significantly less than this operating pressure as a result of a tap 525 being opened the lower limiter switches the pump 530 back on.

In the embodiment of the present invention shown in FIG. 5, the fitting 520 comprises a threaded portion for directly engaging with a threaded fitting of connector 522. The threaded portion of the plumbing may provide an inverse fit for a female plumbing fitting having a diameter equal to one of: ½ inch, ¾ inch, 1 inch or any fitting up to 12 inches and beyond. Nonetheless, the present invention is not limited to any specific adapter and may include variants to connect the apparatus 500 to a wide range of plumbing fittings.

Thus, the present invention as described herein provides a compact and integrated apparatus capable of removing water from a wide range of plumbing installations. The apparatus of the present invention can be simply deployed and provides a means to remove water from a plumbing installation quickly.

In relation to the detailed description of the different embodiments of the invention, it will be understood that one or more technical features of one embodiment can be used in combination with one or more technical features of any other embodiment where the transferred use of the one or more technical features would be immediately apparent to a person of ordinary skill in the art to carry out a similar function in a similar way on the other embodiment.

In the preceding discussion of the invention, unless stated to the contrary, the disclosure of alternative values for the upper or lower limit of the permitted range of a parameter, coupled with an indication that one of the said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The features disclosed in the foregoing description or the following drawings, expressed in their specific forms or in terms of a means for performing a disclosed function, or a method or a process of attaining the disclosed result, as appropriate, may separately, or in any combination of such features be utilised for realising the invention in diverse forms thereof.

The invention claimed is:

1. An apparatus for purging water from a plumbing installation having at least one faucet or tap, comprising:

a single continuous length of conduit comprising a first connector fixed at a first end thereof and a second connector fixed at a second end thereof;

an air pump;

wherein the first connector is mated with an outlet of the air pump so that upon activation of the air pump, a pressure of air or gas builds up inside the plumbing installation which is subsequently released by opening the faucet or tap downstream of the apparatus so that a sudden expulsion of air or gas that has been pumped into the plumbing installation by the opening of the faucet or tap causes any water that is trapped inside the plumbing installation to exit from the open faucet or tap;

wherein the air pump has a pressure sensor to measure the pressure of the fluid the air pump is pumping and the air pump has a limiter switch to switch the air pump off when the pressure sensor records an upper predetermined pressure limit and to switch the air pump back on when the pressure falls to a value significantly less than an operating pressure as a result of the faucet or tap being opened;

wherein the second connector is mated with a fitting of the plumbing installation;

wherein the first connector includes a valve that allows air or gas to flow in a direction from the first end of the single continuous conduit to the second end of the single continuous conduit;

wherein the apparatus is built into the plumbing installation as an integrated component via the fitting;

wherein the fitting is built into the plumbing installation and fixably attached in-line with the plumbing installation at a location separate from and upstream of the faucet or tap.

2. The apparatus as claimed in claim 1, wherein the second connector includes a valve.

3. The apparatus as claimed in claim 2, wherein the valve of the second connector is openable when the second connector is connected to the fitting of the plumbing installation, and is closable when the second connector is disconnected from the fitting of the plumbing installation.

4. The apparatus as claimed in claim 2, wherein the valve of the second connector stops a flow of air or gas from the second connector when closed.

5. The apparatus as claimed in claim 1, wherein the first connector is an automobile tire connector mated with an outlet connector of an automobile tire pump.

6. The apparatus as claimed in claim 1, wherein the second connector is mated with a corresponding connector of the fitting.

7. The apparatus as claimed in claim 1, wherein the second connector is a female connector, mated with a male connector of the fitting.

8. The apparatus as claimed in claim 1, wherein the second connector is mated with the fitting, the fitting being a threaded plumbing fitting having a diameter equal to one of: ½ inch, ¾ inch, 1 inch or any fitting up to 12 inches and beyond.

9. The apparatus as claimed in claim 1, wherein the second connector is mated with the fitting of the plumbing installation via an adapter.

10. The apparatus as claimed in claim 9, wherein the adapter is mated with the fitting, the fitting being a threaded plumbing fitting having a diameter equal to one of: ½ inch, ¾ inch, 1 inch or any fitting up to 12 inches and beyond.

11. The apparatus as claimed in claim 9, wherein the adapter includes a valve which permits a flow of air or gas from the single continuous conduit to the plumbing installation but which blocks the flow of fluid or gas from the plumbing installation to the single continuous conduit.

12. The apparatus as claimed in claim 1, wherein the single continuous conduit is a tube formed of a flexible or rigid material.

13. The apparatus as claimed in claim 1, wherein the plumbing installation is installed in any one of a mobile home, an occasional or full time residence, a motorized home, a recreational vehicle (RV), a boat or sprinkler system.

14. The apparatus as claimed in claim 1, wherein the single continuous length of conduit further comprises a reservoir, between its first and second ends, the reservoir being capable of storing a quantity of pressurized gas.

15. The apparatus as claimed in claim 1, wherein the single continuous conduit further comprises an electronic or mechanical pressure sensor.

16. The apparatus as claimed in claim 1, wherein the air pump is permanently connected to the plumbing installation.

17. The apparatus as claimed in claim 1, wherein the second connector is permanently connected to the fitting.

18. The apparatus as claimed in claim 1, wherein a wiring loom is used to couple switch means to the air pump, the switch means being located with various other switches on a centrally located electrical control panel.

* * * * *